US005873642A

United States Patent [19]

Domenig

[11] Patent Number: 5,873,642

[45] Date of Patent: Feb. 23, 1999

[54] HANGING FILE BAR SUPPORT ASSEMBLY FOR A DRAWER

[75] Inventor: Georg Domenig, Kernersville, N.C.

[73] Assignee: Grass America, Inc., Kernersville, N.C.

[21] Appl. No.: 948,291

[22] Filed: Oct. 10, 1997

[51] Int. Cl.[6] ..... A47B 96/06

[52] U.S. Cl. ..... 312/183; 160/162; 211/46; 16/93 R; 312/348.5

[58] Field of Search ..... 312/184, 348.5, 312/348.3, 183; 16/93 R, 93 D; 160/162, 46; 211/46, 162, 94.02

[56] References Cited

U.S. PATENT DOCUMENTS

| | | | |
|---|---|---|---|
| 3,017,232 | 1/1962 | Schwab et al. | 312/183 X |
| 4,030,610 | 6/1977 | Alexander | 211/162 X |
| 4,091,933 | 5/1978 | Alexander | 312/184 X |
| 4,219,247 | 8/1980 | Litchfield et al. | 312/184 |
| 4,234,238 | 11/1980 | Figueroa | 312/183 X |
| 5,393,136 | 2/1995 | Grabowski et al. | 312/184 |
| 5,515,980 | 5/1996 | Fotioo | 211/46 |
| 5,678,797 | 10/1997 | Gogan | 312/348.5 X |

*Primary Examiner*—Peter M. Cuomo
*Assistant Examiner*—Stephen Vu
*Attorney, Agent, or Firm*—John M. Harrington; Kilpatrick Stockton LLP

[57] ABSTRACT

A hanging file bar support assembly for a drawer includes at least one elongate rail with opposing ends adapted to be mounted on opposite walls of a drawer and at least one clip supported on the rail which has a clip body. The clip body is provided with a hook member extending from the front side of the clip body near an end of the clip body which engages a top edge of the rail and a detent member extending from its opposite end which engages a bottom edge of the rail. The clip body also has a cantilever member extending from its back side which is adapted to support an end of a hanging file bar.

15 Claims, 5 Drawing Sheets

HANGING FILE BAR SUPPORT ASSEMBLY FOR A DRAWER

BACKGROUND OF THE INVENTION

1. Field of the Invention.

The present invention relates to a hanging file bar support assembly for a drawer in a furniture article such as a desk or cabinet, and more particularly to a new and improved clip and rail assembly to support a hanging file bar, which in turn supports a hanging file in a drawer.

2. Description of the Prior Art.

A type of assembly for supporting a hanging file bar in a drawer in a furniture article such as desk or cabinet used in the furniture and cabinetry industry for many years utilizes a side bar supported with its opposing ends inserted in slots formed in the front and back walls of the drawer, which in turn supports a hanging file. Such assemblies are inexpensively made and hence not precisely designed or machined to ensure stability, long wear and efficient operation. In order to provide a more durable, longer lasting hanging file bar support assembly, it has been determined that more refined design and engineering skills are required. The present invention addresses this need and interest.

SUMMARY OF THE INVENTION

The general purpose of the present invention, which will be described subsequently in greater detail, is to provide a new and improved hanging file bar support assembly to be used in a desk or cabinet drawer that has all of the advantages of prior art assemblies and none of the disadvantages. In order to attain this purpose, a representative embodiment of the present invention is illustrated in the drawings. The hanging file bar support assembly of the present invention makes use of a clip supported on an elongate rail to support an end of a hanging file bar, which in turn supports an end of a hanging file. The elongate rail has opposing ends which are mounted on opposing walls, such as a back and front wall of a drawer. The clip includes a clip body with opposing front and back sides and opposing ends. The clip body is provided with a hook member which extends from its front side at or near one of its opposing ends and which engages a top edge of the rail. The clip body is also provided with a detent member extending from its front side at or near the other of its opposing ends which engages a bottom edge of the rail. The clip is further provided with a cantilever member which extends from its back side and is adapted to support the end of the hanging file bar.

The hook member includes a base portion which extends from the front side of the clip body and a ledge portion which depends from the base portion. The base portion is configured as a wall extending substantially perpendicular to the front side of the clip body, and the ledge portion depends substantially perpendicular to the base portion or wall. The detent member includes at least one resilient finger which extends from the front side of the clip body and a boss disposed on the resilient finger. The resilient finger extends substantially perpendicular to the front side of the clip body. Preferably, the detent member also includes a second resilient finger extending from the front side of the clip body substantially parallel to the first resilient finger and a boss disposed on the second resilient finger. The cantilever member includes a pair of opposing side walls extending from the back side of the clip body and an end wall extending from the back side of the clip body and connecting the opposing side walls to define a substantially U-shaped channel. The opposing side walls and the end wall extend substantially perpendicular to the back side of the clip body.

Preferably, the opposing ends of the rail are bent perpendicular to the rail in order to be mounted directly on the opposing walls of the drawer when the opposing walls, for example, the front and back walls of the drawer, are taller than the connecting walls, for example, the side walls of the drawer as in a drawer arrangement utilizing a pair of drawer side rails. In such a drawer arrangement, the elongate rail is mounted directly on the opposing walls and adds a certain degree of rigidity to the arrangement and avoids any possibility that the opposing walls may tilt in directions opposite one another and the pressure from the contents of the drawer or under externally applied force. For such an installation, it is necessary to manufacture and maintain a supply of rails in one or more predetermined lengths, corresponding to the distance between the opposing walls for a variety of drawer sizes.

Alternatively, when the possibility of tilting of the opposing walls in opposite directions is not a potential problem, for example, when the opposing walls and the connecting walls of the drawer are substantially the same height as in, for example, a drawer arrangement utilizing a drawer side wall, the elongate rail may have one bent end for mounting directly on only one of the opposing walls of a drawer and an opposing straight end, which can be inserted into a bracket attached to the other wall. For such an installation, the elongate rail can easily be cut to an appropriate length to fit, so it is not necessary to maintain a supply of rails in various lengths to accommodate different drawer sizes. The bracket has a bracket body with a front side and a back side and a support member extending from the back side to receive the straight end of the elongate rail. The support member includes a pair of opposing side walls extending from the back side of the bracket body and a pair of opposing end walls likewise extending from the back side of the bracket body and connecting the opposing side walls. The opposing side walls and the opposing end walls extend substantially perpendicular to the back side of the bracket body.

The elongate rail has a web portion extending between the top edge and the bottom edge of the rail and a top flange extending from the top edge and a bottom flange extending from the bottom edge of the rail. The web portion includes a longitudinally extending ridge, and the top flange and the bottom flange extend substantially perpendicular to the web portion of the rail. The longitudinally extending ridge of the rail imparts additional rigidity to the rail in order to avoid the possibility of bending or warping of the rail under a heavy load. The top flange and the bottom flange likewise impart additional rigidity to the rail to further avoid the possibility of bending or warping of the rail under a heavy load.

Preferably, a pair of the rails is used in the drawer with one of the rails installed on each of the opposite sides of the drawer between the opposing walls of the drawer. Likewise, preferably a pair of the clips are installed on each of the rails. The clips are installed on the rails with the base portion or wall of the hook member resting on the top flange of the rail and the ledge portion of the hook member overhanging the top flange. The bosses disposed on the resilient fingers are configured to slide over the bottom flange of the rail, deflecting the resilient fingers away from the bottom flange when the body of the clip is pressed toward the web portion of the rail, and snap-locks behind the bottom flange with the body of the clip confronting the web portion of the rail and the resilient fingers resting against the bottom flange of the rail. A pair of hanging file bars is installed with each end of each hanging file bar inserted into the U-shaped channel of the cantilever member on the back side of the clip body of each clip, and each end of the hanging file is in turn hooked over and supported by one of the file bars.

The forgoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and being carried out in various ways.

It is to be further understood that the phraseology and terminology employed herein are for the purpose of description and are not to be regarded as limiting. Those skilled in the art will appreciate that the conception upon which this disclosure is based may readily be used as a basis for designing the structures, methods and systems for carrying out the several purposes of the present invention. The claims are regarded as including such equivalent constructions so long as they do not department from the spirit and scope of the present invention.

From the foregoing summary, it is apparent that an object of the present invention is to provide a new and improved assembly for supporting a hanging file bar in a drawer of a furniture article such as a desk or cabinet which has all the advantages, and more, of prior art devices and none of the disadvantages.

It is another object of the present invention to provide a new and improved hanging file bar support assembly that is more reliable and functional than those presently available.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, reference should be made to the accompanying drawings in which characters of reference designate like parts throughout the several views.

BRIEF DESCRIPTION OF THE DRAWINGS

This invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
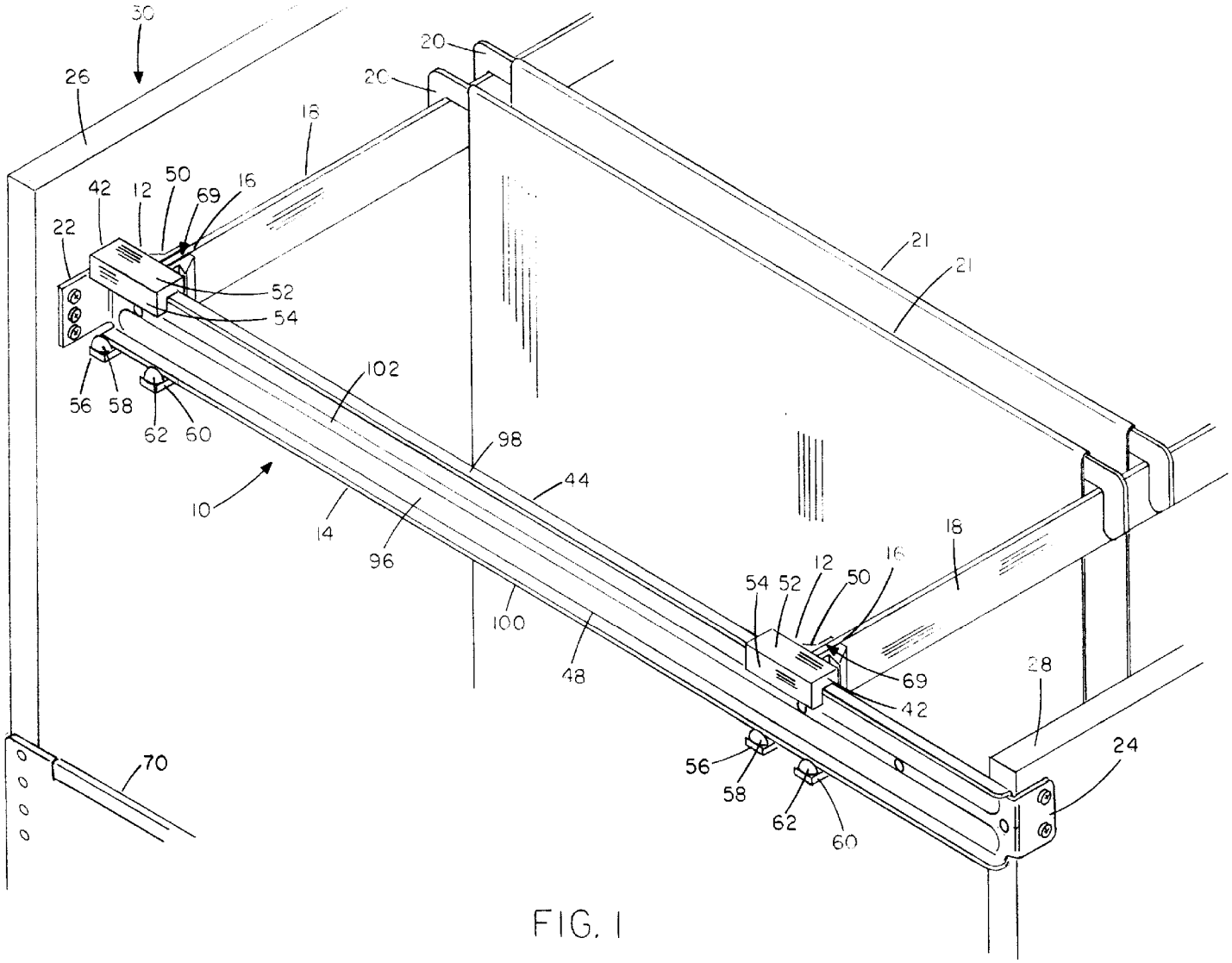
FIG. 1 is a perspective and fragmentary view of a drawer showing the hanging file bar support assembly according to the present invention.
Figure 3:
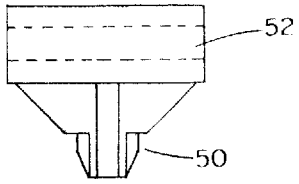
FIG. 3 is an end view of the clip of the hanging file bar support assembly shown in FIG. 1.
Figure 2:
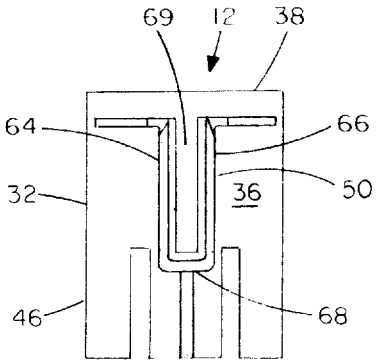
FIG. 2 is a rear view of the clip of the hanging file bar support assembly shown in FIG. 1.
Figure 5:
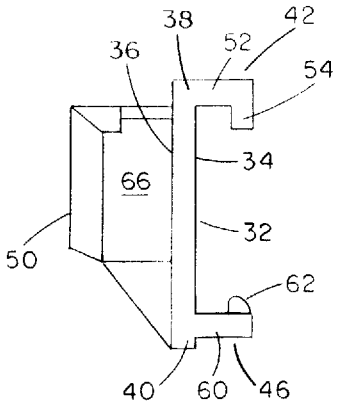
FIG. 5 is a side view of the clip of the hanging file bar support assembly as shown in FIG. 1.
Figure 6:
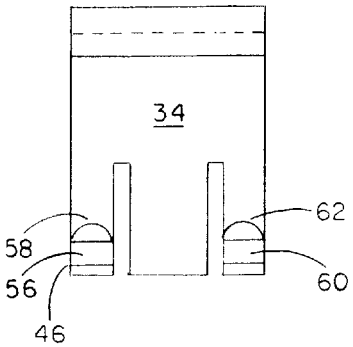
FIG. 6 is a front view of the clip of the hanging file bar support assembly shown in FIG. 1.
Figure 4:
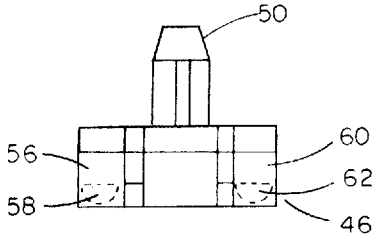
FIG. 4 is an opposite end view of the clip of the hanging file bar support assembly as shown in FIG. 1.

A hanging file bar support assembly according to the present invention, shown generally as 10 in FIG. 1, make use of a clip 12 supported on an elongate rail 14 to support an end 16 of a hanging file bar 18, which in turn supports an end 20 of a hanging file 21. As shown in FIG. 1, rail 14 has opposing ends 22, 24 mounted on opposing walls 26, 28 of a drawer 30. Referring to FIGS. 2–6, clip 12 includes a clip body 32 with opposing front and back sides 34, 36 and opposing ends 38, 40. Clip body 32 is provided with a hook member 42 extending from its front side 34 at or near one of its opposing ends 38 which engages a top edge 44 of rail 14 and a detent member 46 extending from its front side 34 at or near the other of its opposing ends 40 which engages a bottom edge 48 of rail 14. Clip 1 2 is also provided with a cantilever member 50 which extends from its back side 36 and is adapted to support the end 16 of hanging file bar 1 8.

The hook member 42 includes a base portion 52 extending from the front side 34 of clip body 32 and a ledge portion 54 depending from base portion 52. The base portion 52 is configured as a wall extending substantially perpendicular to the front side 34 of clip body 32, and the ledge portion 54 of hook member 42 depends substantially perpendicular to base portion or wall 52. The detent member 46 includes at least one resilient finger 56 extending from the front side 34 of clip body 32 and a boss 58 disposed on resilient finger 56. Resilient finger 56 extends substantially perpendicular to front side 34. Preferably, the detent member 46 also includes a second resilient finger 60 extending from the front side 34 of clip body 32 substantially parallel to resilient finger 56 and a boss 62 disposed on the second resilient finger 60. The cantilever member 50 includes a pair of opposing side walls 64, 66 extending from the back side 36 of clip body 32 and an end wall 68 extending from back side 36 and connecting opposing side walls 64, 66 to define a substantially U-shaped channel 69. The opposing side walls 64, 66 and the end wall 68 extend substantially perpendicular to the back side 36 of clip body 32.

Preferably, the opposing ends 22, 24 of rail 14 are bent perpendicular to rail 14 in order to be mounted directly on the opposing walls 26, 28 of drawer 30, as shown in FIG. 1, when opposing walls 22, 24 are taller than the connecting walls of the drawer as in, for example, a drawer arrangement utilizing a drawer side rail 70. In such a drawer arrangement, rail 14 mounted directly on opposing walls 26, 28 adds a certain degree of rigidity to the arrangement and avoids any possibility that opposing walls 26, 28 may tilt in directions opposite one another under pressure from the contents of the drawer or under externally applied force. For such an installation, it is obviously necessary to manufacture and maintain a supply of rails 14 in one or more predetermined lengths corresponding to the distance between opposing walls 26, 28 for a variety of drawer sizes.

Figure 7:
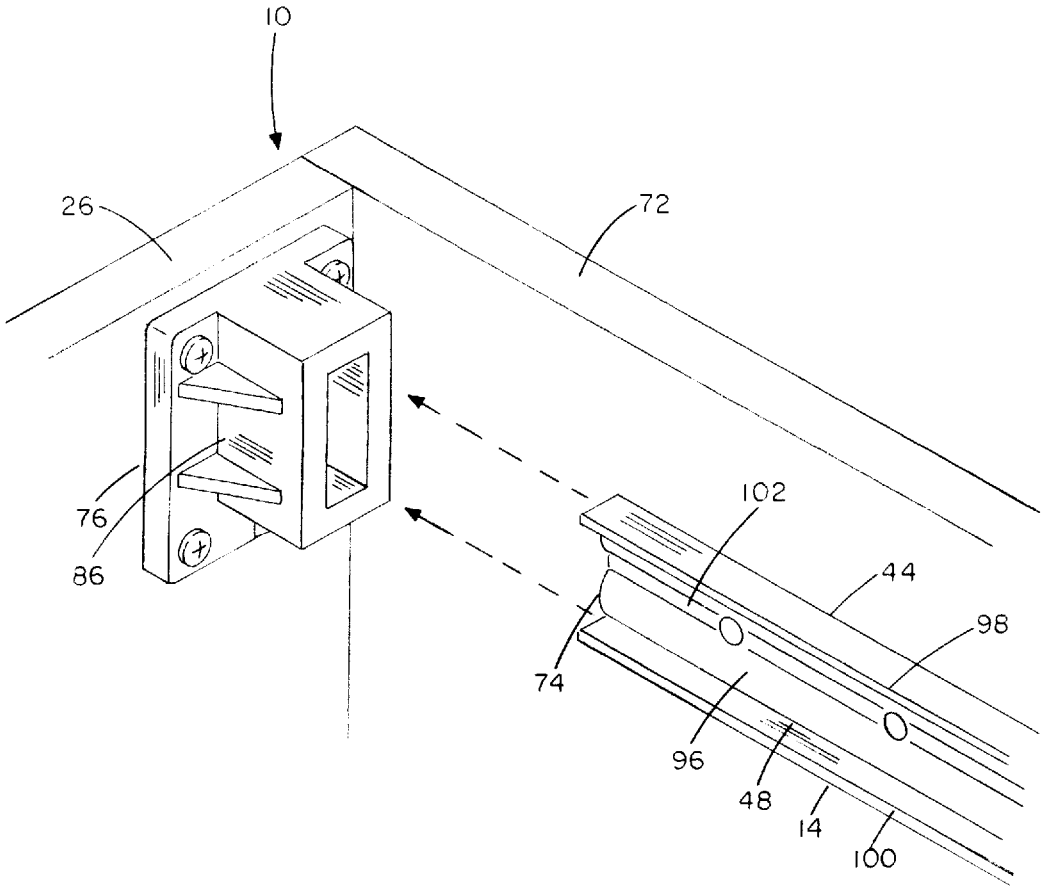
FIG. 7 is perspective and fragmentary view of a drawer showing a bracket for use with the hanging file bar support assembly as shown in FIG. 1.
Figure 9:
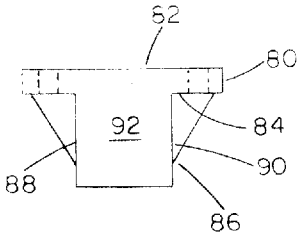
FIG. 9 is an end view of the bracket as shown in FIG. 7.
Figure 8:
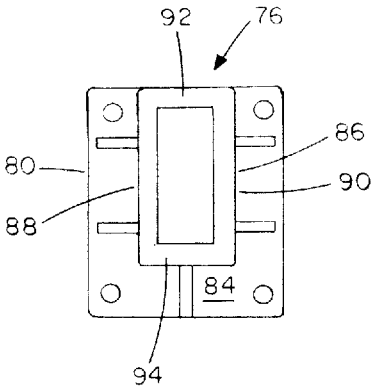
FIG. 8 is a rear view of the bracket as shown in FIG. 7.
Figure 11:
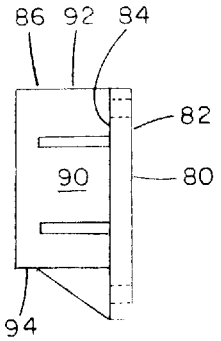
FIG. 11 is a side view of the bracket as shown in FIG. 7.
Figure 12:
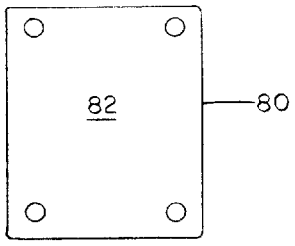
FIG. 12 is a front view of the bracket as shown in FIG. 7.
Figure 10:
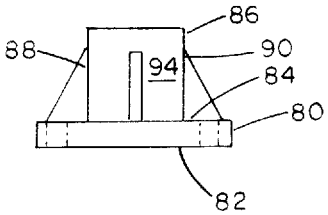
FIG. 10 is a opposite end view of the bracket as shown in FIG. 7.

Alternatively, when the possibility of tilting of walls 26, 28 in opposite directions is not a potential problem, for example, when the opposing walls 26, 28 and the connecting walls of the drawer are substantially the same height as in, for example, a drawer arrangement utilizing a drawer side wall 72, as shown in FIG. 7, the rail 14 may have one bent end for mounting directly on only one of the opposing walls of the drawer and an opposing straight end 74, which can be inserted into a bracket 76 attached to the other wall 26. For such an installation, rail 14 can easily be cut to an appropriate length to fit, so it is not necessary to maintain a supply of rails 14 in various lengths to accommodate different drawer sizes. Referring to FIGS. 8–12, the bracket 76 has a bracket body 80 with a front side 82 and a back side 84 and a support member 86 extending from back side 84 of bracket body 80 to receive the straight end 74 of rail 14, as shown in FIG. 7. The support member 86 includes a pair of opposing side walls 88, 90 extending from the back side 84 of bracket body 80 and a pair of opposing end walls 92, 94 likewise extending from the back side 84 and connecting the opposing side walls 88, 90. The opposing side walls 88, 90 and the opposing end walls 92, 94 extend substantially perpendicular to the back side 84 of bracket body 80.

In the preferred embodiment, the elongate rail 14 has a web portion 96 extending between the top edge 44 and the bottom edge 48 of rail 14 and a top flange 98 extending from top edge 44 and a bottom flange 100 extending from bottom edge 48. The web portion 96 includes a longitudinally extending ridge 102, and the top flange 98 and bottom flange 100 extend substantially perpendicular to the web portion 96 of rail 14. The longitudinally extending ridge 102 of rail 14 imparts additional rigidity to rail 14 in order to avoid the possibility of bending or warping of rail 14 under a heavy load. The top flange 98 and the bottom flange 100 likewise impart additional rigidity to rail 14 to further avoid the possibility of bending or warping of rail 14 under a heavy load.

Figure 13:
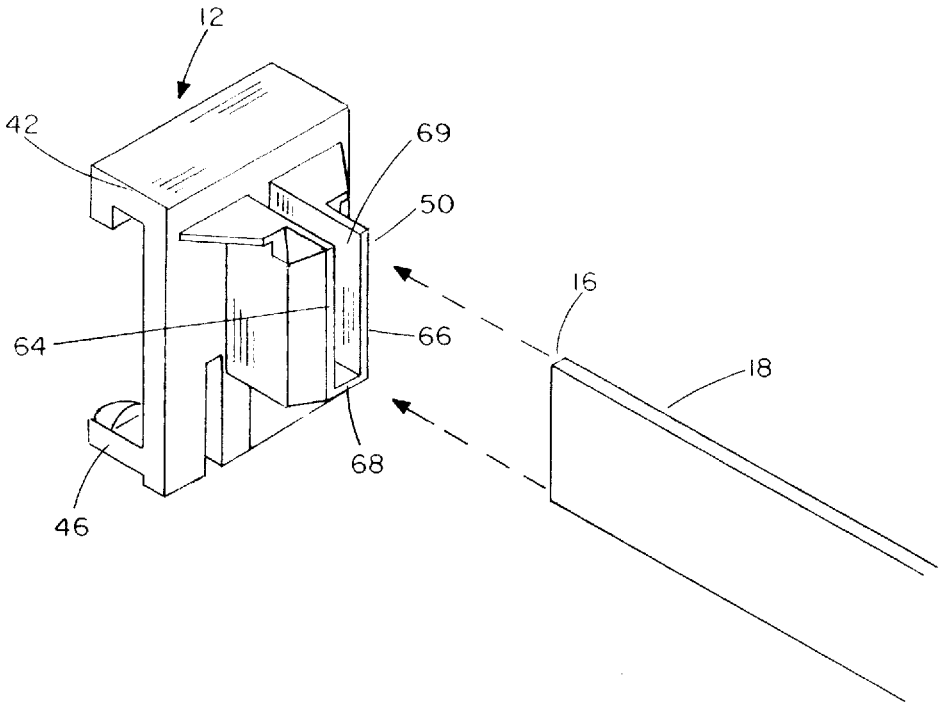
FIG. 13 is a perspective view of the clip as shown in FIGS. 2–6.

Preferably, a pair of the rails 14 is used in the drawer 30 with one of the rails 14 installed on each of the opposite sides of drawer 30 between the opposing walls 26, 28 of drawer 30. Likewise, preferably a pair of the clips 12 is installed on each of the rails 14. The clips 12 are installed on rails 1 4 with the base portion or wall 52 of hook member 42 resting on the top flange 98 of rail 14 and the ledge portion 54 of hook member 42 overhanging top flange 98. The bosses 58, 62 disposed on resilient fingers 56, 60 are configured to slide over the bottom flange 100 of rail 14, deflecting the resilient fingers 56, 60 away from bottom flange 100 when the body 32 of clip 12 is pressed toward the web portion 96 of rail 14, and to snap lock behind bottom flange 100 with body 32 of clip 12 confronting web portion 96 of rail 14 and resilient fingers 56, 60 resting against bottom flange 100. The clip 12 can be removed from rail 14 by manually deflecting the resilient fingers away from bottom flange 100 and pressing the body 32 of clip 12 away from web portion 96 of rail 14. A pair of hanging file bars 18 is installed with each end 16 inserted into the U-shaped channel 69 of cantilever member 50 on the back side 36 of clip body 32 of each clip 12, as shown in FIG. 13, and each end 20 of hanging file 21 is in turn hooked over and supported by one of the file bars 18.

Obviously, any number of materials may be used to form the components of the hanging file bar support assembly described herein, and exceptional success has been experienced by the use of semi-rigid plastic material for the clip and bracket components, and exceptional success has also been experienced by the use of rails and hanging file bars stamped from sheet metal, although other materials may be used when greater or lesser support is necessary.

With respect to the descriptions set forth above, optimum dimensional relationship of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principals of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A hanging file bar support assembly for a drawer, comprising:

at least one elongate rail with top and bottom edges and having opposing ends adapted to be mounted on opposing walls of the drawer;

at least one clip supported on the rail and having a clip body with opposing front and back sides and opposing ends and being provided with a hook member extending from the front side proximate one of the opposing ends of the clip body and engaging the top edge of the rail and a detent member extending from the front side proximate another of the opposing ends of the clip body and engaging the bottom edge of the rail, and the clip body also being provided with a cantilever member extending from the back side of the clip body and adapted to support an end of the hanging file bar, the detent member including at least one resilient finger extending from the front side of the clip body and a boss disposed on the resilient finger;

the hook member including a base portion extending from the front side of the clip body and a ledge portion depending from the base portion; and the base portion of the hook member comprising a wall extending substantially perpendicular to the front side of the clip body, and the ledge portion of the hook member depending substantially perpendicular to the wall.

2. The hanging file bar support assembly of claim 1, said at least one resilient finger extending substantially perpendicular to the front side of the clip body.

3. The hanging file bar support assembly of claim 2, the detent member including a second resilient finger extending from the front side of the clip body substantially parallel to said at least one resilient finger and a boss disposed on the second resilient finger.

4. The hanging file bar support assembly of claim 1, the cantilever member including a pair of opposing side walls extending from the back side of the clip body and an end wall extending from the back side of the clip body and connecting the opposing side walls to define a substantially U-shaped channel.

5. The hanging file bar support assembly of claim 4, the opposing side walls and end wall extending substantially perpendicular to the back side of the clip body.

6. The hanging file bar support assembly of claim 1, the elongate rail having a web portion extending between the top and bottom edges of the rail, a top flange extending from the top edge of the rail, a bottom flange extending from the bottom edge of the rail, and the web portion including a longitudinally extending ridge.

7. The hanging file bar support assembly of claim 6, the top and bottom flanges extending substantially perpendicular to the web portion of the rail.

8. A hanging file bar support assembly for a drawer, comprising:

at least one elongate rail with top and bottom edges and having opposing ends adapted to be mounted on opposing walls of the drawer; and at least one clip supported on the rail and having a clip body with opposing front and back sides and opposing ends and being provided with a hook member extending from the front side proximate one of the opposing ends of the clip body and engaging the top edge of the rail and a detent member extending from the front side proximate the other of the opposing ends of the clip body and engaging the bottom edge of the rail, and the clip body also being provided with a cantilever member extending from the back side of the clip body and adapted to support an end of the hanging file bar, the hook member including a base portion extending from the front side of the clip body and a ledge portion depending from the base portion the base portion of the hook member comprising a wall extending substantially perpendicular to the front side of the clip body, and the ledge portion of the hook member depending substantially perpendicular to the wall, the detent member including at least one resilient finger extending from the front side of the clip body and a boss disposed on the resilient finger, said at least one resilient finger extending substantially perpendicular to the front side of the clip body, and the detent member including a second resilient finger extending from the front side of the clip body substantially parallel to said at least one resilient finger and a boss disposed on the second resilient finger.

9. The hanging file bar support assembly of claim 8, the cantilever member including a pair of opposing side walls extending from the back side of the clip body and an end wall extending from the back side of the clip body and connecting the opposing side walls to define a substantially U-shaped channel, and the opposing side walls and end wall extending substantially perpendicular to the back side of the clip body.

10. The hanging file bar support assembly of claim 9, the elongate rail having a web portion extending between the top and bottom edges of the rail, a top flange extending from the top edge of the rail, a bottom flange extending from the bottom edge of the rail, and the top and bottom flanges extending substantially perpendicular to the web portion, and the web portion including a longitudinally extending ridge.

11. A hanging file bar support assembly for a drawer, comprising:

a clip having a clip body with opposing front and back sides and opposing ends and being provided with a hook member extending from the front side proximate one of the opposing ends of the clip body and adapted to engage a top edge of a rail having opposing ends adapted to be mounted on opposing walls of the drawer, the clip body also being provided with a detent member extending from the front side proximate another of the opposing ends of the clip body and adapted to engage a bottom edge of the rail, and the detent member including at least one resilient finger extending from the front side of the clip body and a boss disposed on the resilient finger;

the hook member including a base portion extending from the front side of the clip body and a ledge portion depending from the base portion; and the base portion of the hook member comprising a wall extending substantially perpendicular to the front side of the clip body, and the ledge portion of the hook member depending substantially perpendicular to the wall.

12. The hanging file bar support assembly of claim 11, the at least one resilient finger extending substantially perpendicular to the front side of the clip body.

13. The hanging file bar support assembly of claim 12, the detent member including a second resilient finger and a boss disposed on the second resilient finger.

14. The hanging file bar support assembly of claim 11, the cantilever member including a pair of opposing side walls extending from the back side of the clip body and an end wall extending from the back side of the clip body and connecting the opposing side walls to define a substantially U-shaped channel.

15. The hanging file bar support assembly of claim 14, the opposing side walls and end wall extending substantially perpendicular to the back side of the clip body.

* * * * *